US007495527B2

(12) United States Patent
Ornt et al.

(10) Patent No.: US 7,495,527 B2
(45) Date of Patent: Feb. 24, 2009

(54) CONNECTOR ACTIVATED RF SWITCH

(75) Inventors: Gregory George Ornt, Sodus Point, NY (US); Brent Eric Raiber, Springville, NY (US); Brian Edward Simpson, Rochester, NY (US); Kenneth P. Beghini, Spencerport, NY (US)

(73) Assignee: Harris Corporation, Melbourne, FL (US)

( * ) Notice: Subject to any disclaimer, the term of this patent is extended or adjusted under 35 U.S.C. 154(b) by 342 days.

(21) Appl. No.: 11/387,382

(22) Filed: Mar. 23, 2006

(65) Prior Publication Data

US 2007/0222538 A1 Sep. 27, 2007

(51) Int. Cl.
*H01P 1/10* (2006.01)

(52) U.S. Cl. ..... 333/105; 333/262

(58) Field of Classification Search ..... 333/105, 333/262; 335/4, 5; 200/329, 504
See application file for complete search history.

(56) References Cited

U.S. PATENT DOCUMENTS 3,600,542 A * 8/1971 Richter ..... 200/288
4,361,309 A * 11/1982 Sogabe ..... 251/129.08
4,496,919 A * 1/1985 Fournier et al. ..... 335/5
6,133,812 A * 10/2000 Magda ..... 335/4
6,975,178 B1 * 12/2005 Kessler et al. ..... 333/105

* cited by examiner

*Primary Examiner*—Benny Lee
*Assistant Examiner*—Alan Wong
(74) *Attorney, Agent, or Firm*—Darby & Darby; Robert J. Sacco

(57) ABSTRACT

An RF switch (104) that is activated by the insertion of a connector. The RF switch (104) can comprise one or more antenna adapters that can be formed by a number of predetermined RF connector types. The RF switch can include a switch housing (204). A first, second, and third coaxial RF connectors (201, 202, 203) can be mounted to the switch housing (204). The first, second, and third coaxial RF connectors (201, 202, 203) can individually have both an inner and outer conductor (205-206; 207-208; 209-210, respectively). An actuator (501) can be movable from a first position to a second position responsive to a mechanical force applied to the third coaxial connector (203). A switch element (512) can be responsive to the actuator (501). When in the first position, the switch element (512) can exclusively form a conductive path between the first and second coaxial RF connectors (201, 202). When the actuator (501) is in the second position, the switch element (512) can exclusively form a conductive path between the first and third coaxial RF connectors (201, 203).

21 Claims, 4 Drawing Sheets

CONNECTOR ACTIVATED RF SWITCH

BACKGROUND OF THE INVENTION

1. Statement of the Technical Field

The invention concerns antenna equipment, specifically, a connector activated RF switch.

2. Description of the Related Art

Radio devices typically comprise antenna adapters, antenna elements, and antenna switches. An antenna adapter is typically a connector for mechanically and electrically connecting an antenna element or antenna cable to a radio device. An antenna element is a device used for transmitting and receiving radio waves. An antenna cable can be used as a transmission line between the antenna element and the radio device.

There are situations in the field in which a secondary antenna element may be required in addition to a primary antenna element to interchangeably transmit from a common radio device. For existing radio devices that only have a single antenna connector, the antenna switching process requires having to physically disconnect the primary antenna element/cable from the radio device's antenna connector and, in its place, attach the end connector of the secondary antenna element/cable.

Internal antenna switches are provided on some radio equipment to allow an operator to selectively connect the radio to two or more antennas. Usually these systems provide two or more connectors on the chassis of the radio to which each antenna can be connected. However, not all radios provide this convenience feature. Despite the various configurations known in the art, there remains a need for a device that can allow an operator to easily switch between two different antennas. At the same time, the device should allow the primary antenna/cable to remain attached to the radio device, facilitating antenna switch over. Moreover, the device should serve as a stand alone accessory so that the secondary antenna elements/cables can quickly connect to and disconnect from a radio device as needed.

SUMMARY OF THE INVENTION

The invention relates to an RF switch. The RF switch can include a switch housing. A first, second, and third coaxial RF connector can be mounted to the switch housing. The first, second, and third coaxial RF connectors can each have both an inner and outer conductor. The third coaxial RF connector can be of a predetermined sex and can be of a different connector type as compared to the first and second coaxial RF connectors.

An actuator can be movable from a first position to a second position responsive to a mechanical force applied to the third RF coaxial connector. According to one alternative, the actuator can be comprised of a resiliently biased pin. The resiliently biased pin can be movable in a direction aligned with an insertion axis of the third coaxial RF connector. The insertion axis can be defined by an insertion direction of a mating coaxial RF connector into the third coaxial RF connector. The resiliently biased pin can be resiliently biased in a direction away from the RF switch housing. The pin can slide within an elongated sleeve defined by the third RF coaxial connector.

The pin can include a bore extending along a portion of a length of the pin from an aperture on a first end portion of the pin. The aperture can be sized and shaped for receiving a center conductor portion of an oppositely sexed connector of the same type. The pin can further include a tip end defined on a second end portion opposed from the aperture. When the pin is in the second position, the tip end can engage the switch element. Thus, the pin can form an electrical connection with the switch element.

When the actuator is in the first position, a switch element responsive to the actuator can exclusively form a conductive path between the first and second coaxial RF connectors. When the actuator is in the second position, the switch element can exclusively form a conductive path between the first and third coaxial RF connectors. The RF switch can further include a ground system for forming a ground conductive path connecting the outer conductor of the first, second, and third coaxial RF connectors.

The switch element can include a conductive element that forms at least a portion of the conductive path. The conductive element can be resiliently biased to form the conductive path between the first and second inner conductors when the actuator is in the first position. As one alternative, the conductive element can be a leaf spring. Moreover, the actuator can form an electrical connection with the conductive element when the actuator is in the second position.

BRIEF DESCRIPTION OF THE DRAWINGS

Embodiments will be described with reference to the following drawing figures, in which like numerals represent like items throughout the figures, and in which.

DETAILED DESCRIPTION OF THE PREFERRED EMBODIMENTS

Figure 1:
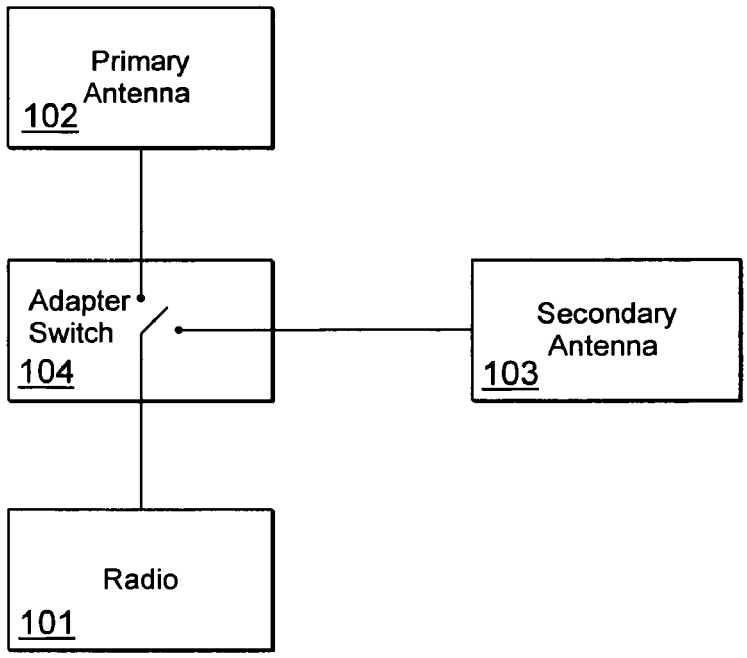
FIG. 1 is a block diagram that is useful for understanding the invention.

FIG. 1 is a block diagram that is useful for understanding the invention. An RF switch 104 can facilitate a connection between a radio device 101, a primary antenna 102 and a secondary antenna 103. The RF switch 104 can be connected to one or more of the primary and secondary antennas 102, 103 using conventional coaxial antenna cables and coaxial connectors. An electrical connection to the radio device 101 can be transferred between the primary antenna 102 and the secondary antenna 103 using a switching mechanism incorporated into the RF switch 104.

Figure 2:
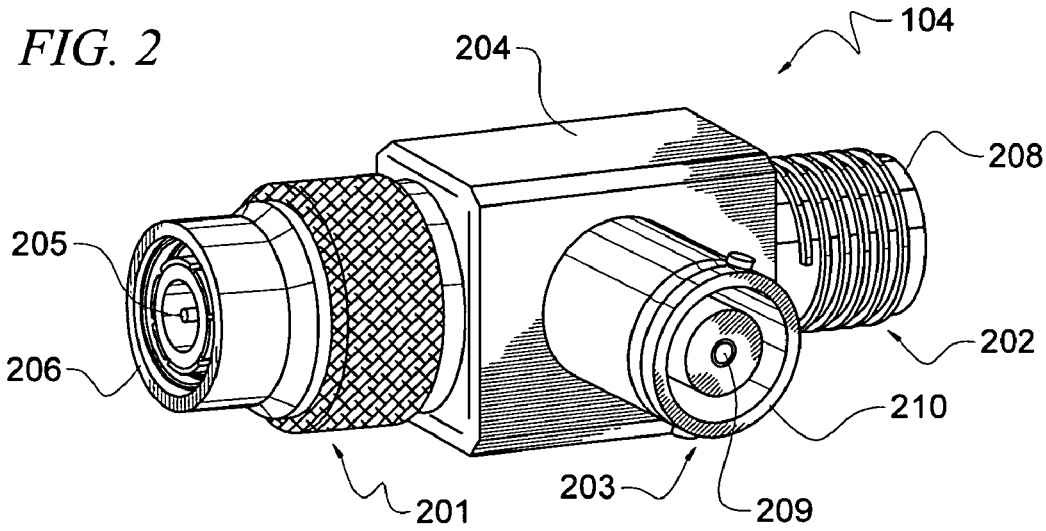
FIG. 2 is a perspective view of the RF switch that is useful for understanding the invention.
Figure 3:
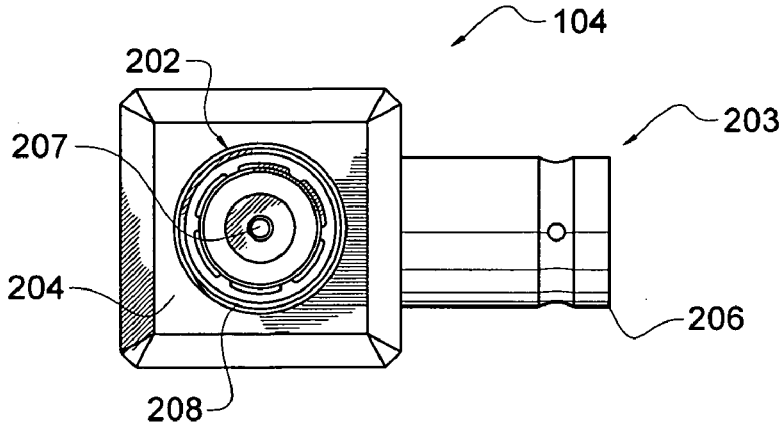
FIG. 3 is a top view of the RF switch that is useful for understanding the invention.
Figure 4:
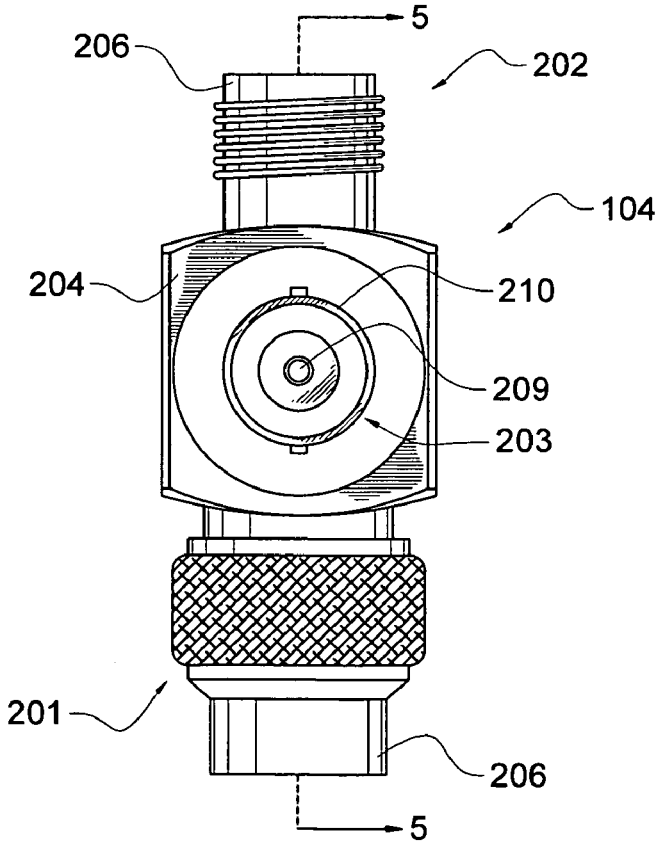
FIG. 4 is a right side elevational view of the RF switch that is useful for understanding the invention.

FIGS. 2-4 illustrate the RF switch 104 in greater detail. The RF switch 104 can include a switch housing 204. The switch housing 204 can enclose a switching mechanism. The switch housing 204 can be formed of a rigid, sturdy material. Examples of such materials include, but are not limited to, iron, aluminum, nickel, copper, and alloys thereof, such as stainless steel and brass. According to one embodiment, the switch housing 204 can have a hard plastic overmold for additional structural protection. Examples of hard plastics suitable for this purpose can include, but are not limited to acrylonitrile butadiene styrene (ABS) and polyvinyl chloride (PVC).

A first, second, and third coaxial RF connector (201, 202, and 203, respectively) can be mounted to the switch housing 204. The first, second, and third coaxial RF connectors 201, 202, 203 can each have both an inner and outer conductor (205-206; 207-208; 209-210, respectively) as shown in FIGS. 2-6. The inner and outer conductors 205-210 should be of a robust design and should communicate RF energy with minimal signal loss within their design frequency range. The first coaxial RF connector 201 can be selected so that it is suitable for mating with a corresponding coaxial RF connector (not shown) mounted on the chassis of the radio device 101. The mating mechanism of the first coaxial RF connector 201 with the coaxial RF base connector can be such that they threadingly engage one another. However, the invention is not limited in this regard and any number of RF connector types can be used. Examples of connector types that can be used as the first coaxial RF connector 201 include, but are not limited to BNC, C, GR, F, IEC 169-2, N, TNC, UHF, DIN 47223, MCX, FME, SMA, SMB, SMC, and APC-7 connector types. The first coaxial RF connector 201 can be any of a wide variety of commercially available or custom RF cable connectors.

The second coaxial RF connector 202 can be selected to be a connector type that is suitable for providing an RF connection with a connector disposed on primary antenna 102, or a coaxial antenna feed line associated with the primary antenna 102. The mating mechanism of the second coaxial RF connector 202 with the coaxial RF connector associated with the primary antenna 102 can be such that they threadingly engage one another. However, the invention is not limited in this regard and any number of RF connector types can be used in the mating mechanism. Examples of connector types that can be used as the second coaxial RF connector 202 include, but are not limited to BNC, C, GR, F, IEC 169-2, N, TNC, UHF, DIN 47223, MCX, FME, SMA, SMB, SMC, and APC-7 connector types. The second coaxial RF connector 202 can be any of a wide variety of commercially available or custom RF cable connectors.

The third coaxial RF connector 203 can be of a predetermined sex and of a same or different connector type as compared to the first and second coaxial RF connectors 201, 202. For example, the third coaxial RF connector 203 can be compatible with any one of a wide variety of conventional connector types including, but not limited to, BNC, C, GR, F, IEC 169-2, N, TNC, UHF, DIN 47223, MCX, FME, SMA, SMB, SMC, and APC-7 connector types. The third coaxial RF connector 203 can be any of a wide variety of commercially available or custom RF cable connectors. Consequently, the third coaxial RF connector 203 can be removably mated with a coaxial RF connector (not shown) associated with a feed line for secondary antenna 103. The RF adapter 104 can further include the ground system 513 for forming the ground conductive path connecting the switch housing 204 and outer conductors 206, 208, 210. Outer conductors 206, 208, 210 are each respectively associated with the first, second, and third coaxial RF connectors 201, 202, 203.

Figure 5:
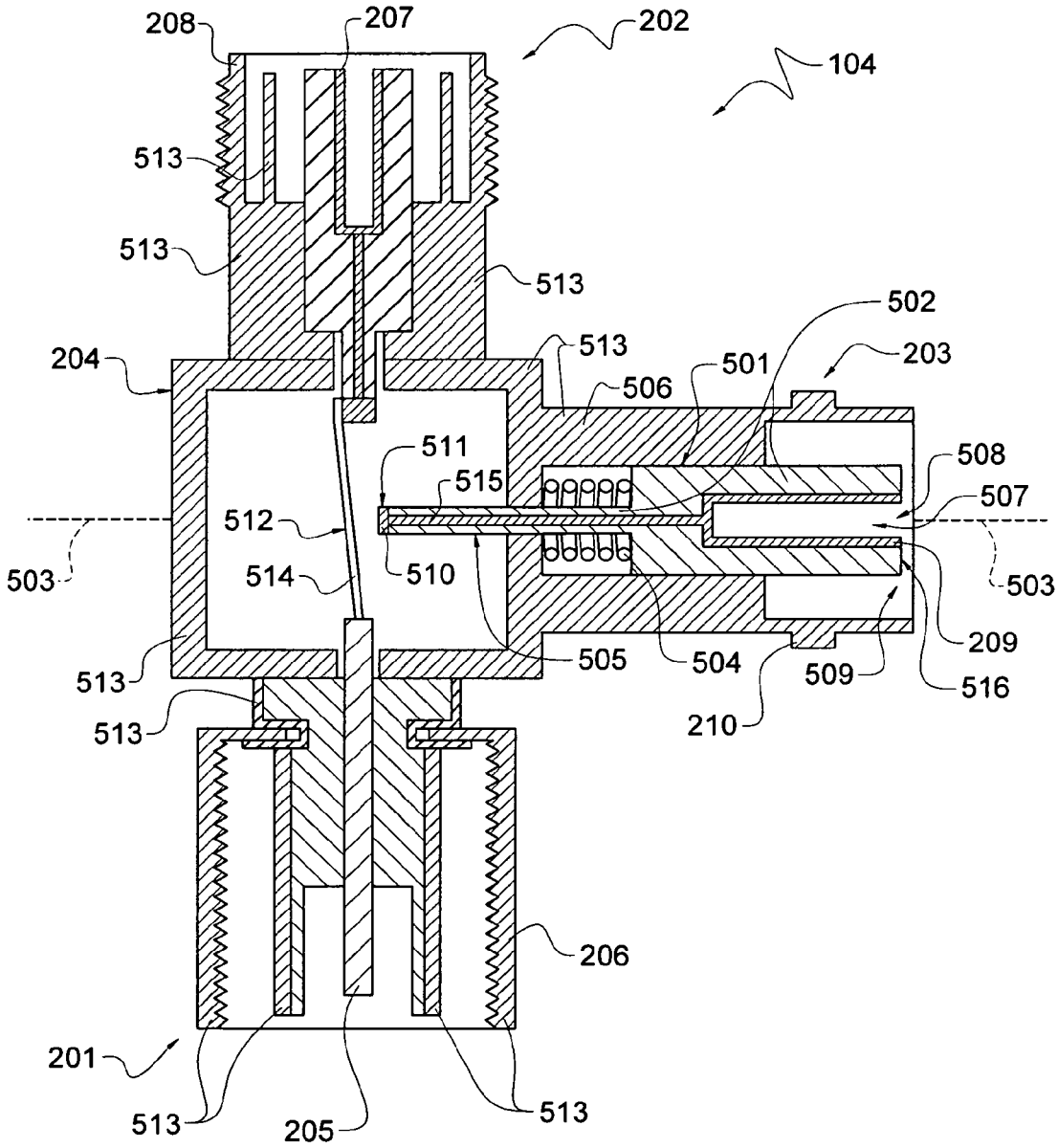
FIG. 5 is a cross-sectional view of the RF switch shown in FIG. 4 taken along the line 5-5 that shows the switch in a first position.
Figure 6:
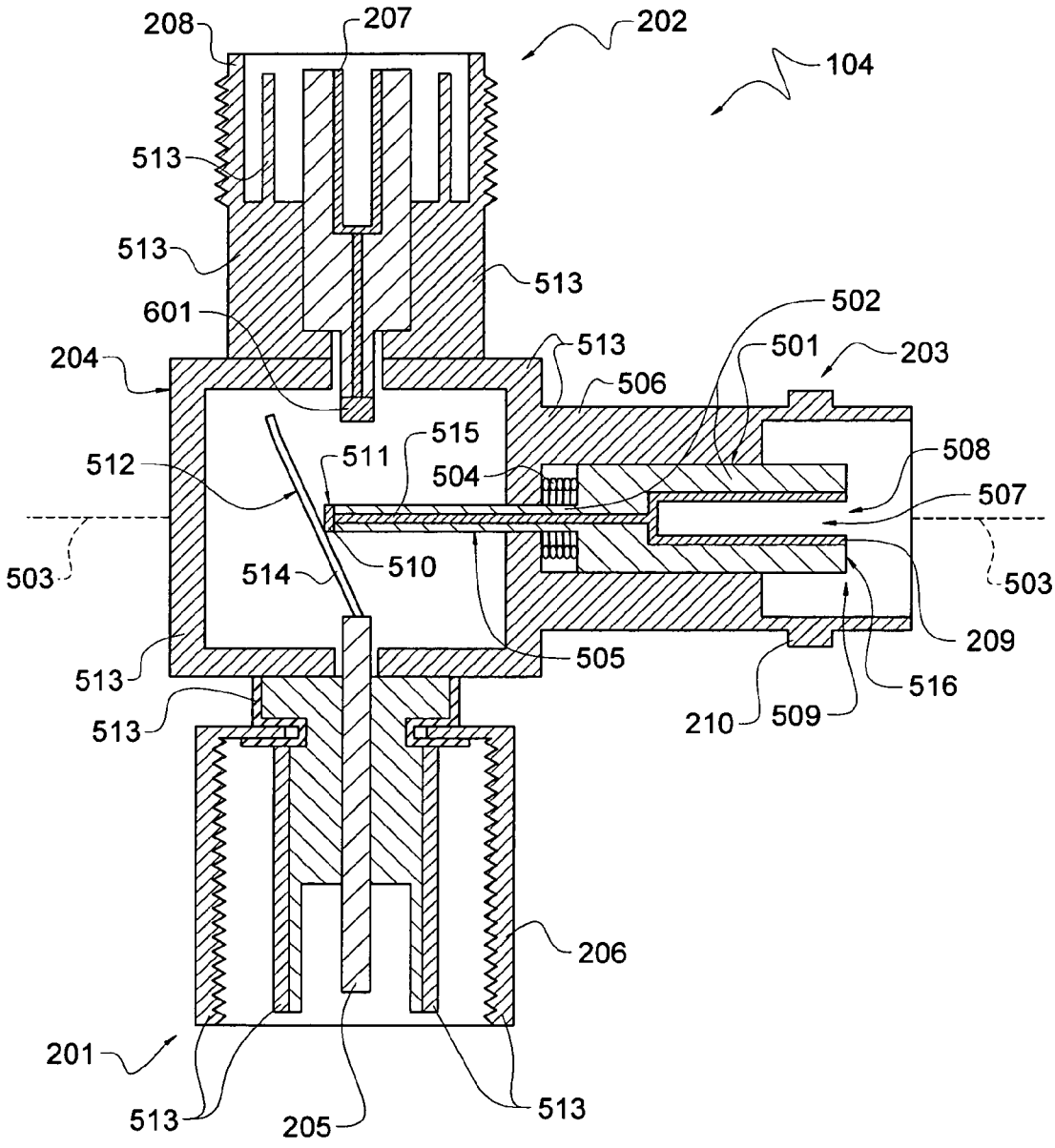
FIG. 6 is a cross-sectional view shown of the RF switch shown in FIG. 4 taken along the line 5-5 that shows the device in a second position.

Referring to FIGS. 5 and 6, the third coaxial RF connector 203 can have a mechanical actuator that is movable from a first position to a second position. The movement of the actuator from the first position to the second position can be responsive to a mechanical force applied to the third RF coaxial connector 203 when mating it with an oppositely sexed connector. For example, the oppositely sexed connector can be a coaxial RF connector associated with secondary antenna 103.

According to one embodiment of the invention, when the actuator is in the first position, a switch element responsive to the actuator can exclusively form a conductive path between the first and second coaxial RF connectors 201, 202. When the actuator is in the second position, the switch element can exclusively form a conductive path between the first and third coaxial RF connectors 201, 203. However, the invention is not limited in this regard and other switching configurations are also possible. It is important to note that the exact mechanical design of the third coaxial RF connector can vary depending upon the type of connector it is intended to be compatible with. The invention is not limited to the particular mechanical arrangement used for switching a particular connector type. All that is necessary is that the mechanical force of mating the connectors can cause the switch to go from the first position to the second position.

FIGS. 5-6 illustrate one example of a mechanical actuator that can be used with the present invention. According to this embodiment of the invention, a mechanical force can be applied to an exterior face 516 of the third RF coaxial connector 203. An actuator 501 can be comprised of a resiliently biased pin 502. The pin 502 can be movable in a direction aligned with an insertion axis 503 of the third coaxial RF connector 203. The insertion axis 503 can be defined by an insertion direction of a mating coaxial RF connector (i.e. coaxial RF connector connected to the secondary antenna 103) into the third coaxial RF connector 203. The pin 502 can slide within an elongated sleeve 506 defined by the third RF coaxial connector 203.

The pin 502 can include a bore 507 extending along a portion of its length from an aperture 508 on a first end portion 509 of the pin 502. The bore can be formed of a conductive material that is sized and shaped to receive a pin from a mating connector. The pin 502 can further include a tip end 510 defined on a second end portion 511 opposed from the aperture 508. The tip end 510 can be formed of a conductive material electrically coupled to the inner conductor 209 of the third RF coaxial connector 203. For example, this electrical coupling can be provided by means of a dielectrically wrapped conductive portion 515 within the narrow portion 505.

The pin 502 can be biased using a resilient biasing member 504 in a direction away from the switch housing 204. For example, the resilient biasing member 504 can include a metal or plastic spring. The spring can be disposed around a narrow portion 505 of the actuator 501. Moreover, the resilient biasing member 504 can be enclosed by a combination that includes portions of the actuator 501, switch casing 204, and the elongated sleeve 506 defined by the third RF coaxial connector 203.

When the actuator 501 is in the first position as shown in FIG. 5, a switch element 512 responsive to the actuator 501 can form a conductive path exclusively between the first and second coaxial RF connectors 201, 202. However, when the actuator 501 is in the second position as shown in FIG. 6, the switch element 512 can form a conductive path exclusively between the first and third coaxial RF connectors 201, 203. When the actuator 501 is in the second position, the actuator's tip end 510 can engage the switch element 512, forming an electrical connection with the switch element 512. By engaging the switch element 512, the actuator's tip end 510 pushes the switch element 512 away from conductive contact 601 formed on the second coaxial RF connector 202. Thus, the switch element electrically disconnects from the conductive contact 601 when the actuator 501 is in the second position. With the foregoing arrangement, the coaxial RF connector associated with a primary antenna 102 can remain mechanically mated to the second coaxial RF connector 202 when a coaxial RF connector of secondary antenna 103 is connected to the third coaxial RF connector 203.

The switch element 512 can include a conductive element 514 that forms at least a portion of the conductive path between the first coaxial RF connector 201 and either one of the second and third coaxial RF connectors 202, 203. The conductive element 514 can be resiliently biased to form the conductive path between the first and second inner conductors (205, 207 respectively) when the actuator 501 is in the first position as shown in FIG. 5. As one alternative, the conductive element 514 can be a leaf spring. However, the invention is not limited in this regard. The conductive element 514 should be of a robust design and should conduct with minimal RF signal loss. Possible materials that can be used to form the conductive element 514 include, but are not limited to: stainless steel, beryllium copper, phosphor bronze, brass, titanium, and Elgiloy®. Moreover, at least a portion of the actuator 501 can form an electrical connection with the conductive element 514 when the actuator 501 is in the second position as shown in FIG. 6.

The foregoing arrangement represents one possible method for implementing an actuator system. However, it is important to note that the switching mechanism described represents merely one possible embodiment of the invention and any number of switching mechanisms can be implemented.

While the specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention, which is to be given the full breadth of the appended claims and any and all equivalents thereof.

What is claimed is:

1. An RF switch, comprising:

a switch housing;

a first coaxial RF connector mounted to said switch housing having an inner conductor and an outer conductor;

a second coaxial RF connector mounted to said switch housing having an inner conductor and an outer conductor;

a third coaxial RF connector of a predetermined sex mounted to said switch housing having an inner conductor and an outer conductor;

an actuator provided on a portion of said third coaxial RF connector configured to engage a mating RF connector of said third coaxial RF connector, said actuator movable from a first position to a second position responsive to a mechanical force applied to said third RF coaxial connector;

a switch element responsive to said actuator exclusively forming a conductive path between said first and second coaxial RF connectors when said actuator is in said first position, and exclusively forming said conductive path between said first and third coaxial RF connectors when said actuator is in said second position.

2. The RF switch according to claim 1, further comprising a ground system forming a ground conductive path connecting said outer conductor of said first, second and third coaxial RF connectors.

3. The RF switch according to claim 1, wherein said switch element is comprised of a conductive element that forms at least a portion of said conductive path.

4. The RF switch according to claim 3, wherein said conductive element is resiliently biased to form said conductive path between said first and second inner conductors when said actuator is in said first position.

5. The RF switch according to claim 4, wherein said conductive element is a leaf spring.

6. An RF switch, comprising:

a switch housing;

a first coaxial RF connector mounted to said switch housing having an inner conductor and an outer conductor;

a second coaxial RF connector mounted to said switch housing having an inner conductor and an outer conductor;

a third coaxial RF connector of a predetermined sex mounted to said switch housing having an inner conductor and an outer conductor;

an actuator movable from a first position to a second position responsive to a mechanical force applied to said third RF coaxial connector; and a switch element responsive to said actuator exclusively forming a conductive path between said first and second coaxial RF connectors when said actuator is in said first position, and exclusively forming said conductive path between said first and third coaxial RF connectors when said actuator is in said second position;

wherein said switch element is comprised of a conductive element that forms at least a portion of said conductive path, said conductive element resiliently biased to form said conductive path between said first and second inner conductors when said actuator is in said first position, said actuator forming an electrical connection with said conductive element when said actuator is in said second position.

7. The RF switch according to claim 1, wherein said third coaxial RF connector is of a different connector type as compared to said first and second coaxial RF connectors.

8. The RF switch according to claim 1, wherein said actuator is comprised of a resiliently biased pin.

9. The RF switch according to claim 8, wherein said resiliently biased pin is movable in a direction aligned with an insertion axis of said third coaxial RF connector, said insertion axis defined by an insertion direction of a mating coaxial RF connector into said third coaxial RF connector.

10. An RF switch, comprising:

a switch housing;

a first coaxial RF connector mounted to said switch housing having an inner conductor and an outer conductor;

a second coaxial RF connector mounted to said switch housing having an inner conductor and an outer conductor;

a third coaxial RF connector of a predetermined sex mounted to said switch housing having an inner conductor and an outer conductor;

an actuator movable from a first position to a second position responsive to a mechanical force applied to said third RF coaxial connector, said actuator comprising a resiliently biased pin resiliently biased in a direction away from said switch housing;

a switch element responsive to said actuator exclusively forming a conductive path between said first and second coaxial RF connectors when said actuator is in said first position, and exclusively forming said conductive path between said first and third coaxial RF connectors when said actuator is in said second position.

11. An RF switch, comprising:

a switch housing;

a first coaxial RF connector mounted to said switch housing having an inner conductor and an outer conductor;

a second coaxial RF connector mounted to said switch housing having an inner conductor and an outer conductor;

a third coaxial RF connector of a predetermined sex mounted to said switch housing having an inner conductor and an outer conductor;

an actuator movable from a first position to a second position responsive to a mechanical force applied to said third RF coaxial connector; and a switch element responsive to said actuator exclusively forming a conductive path between said first and second coaxial RF connectors when said actuator is in said first position, and exclusively forming said conductive path between said first and third coaxial RF connectors when said actuator is in said second position;

wherein said actuator is comprised of a resiliently biased pin, said resiliently biased pin comprises a bore extending along a portion of a length of said resiliently biased pin from an aperture on a first end portion of said resiliently biased pin, and a tip end defined on a second end portion opposed from said aperture.

12. The RF switch according to claim 11, wherein said tip end engages said switch element when said resiliently biased pin is in said second position.

13. The RF switch according to claim 12, wherein said resiliently biased pin forms an electrical connection with said switch element when said resiliently biased pin is in said second position.

14. An RF switch, comprising:

a switch housing;

a first coaxial RF connector mounted to said switch housing having an inner conductor and an outer conductor;

a second coaxial RF connector mounted to said switch housing having an inner conductor and an outer conductor;

a third coaxial RF connector of a predetermined sex mounted to said switch housing having an inner conductor and an outer conductor;

an actuator movable from a first position to a second position responsive to a mechanical force applied to said third RF coaxial connector; and a switch element responsive to said actuator exclusively forming a conductive path between said first and second coaxial RF connectors when said actuator is in said first position, and exclusively forming said conductive path between said first and third coaxial RF connectors when said actuator is in said second position;

wherein said actuator is comprised of a resiliently biased pin, said resiliently biased pin is configured for sliding within an elongated sleeve defined by said third RF coaxial connector.

15. An RF switch, comprising:

a switch housing;

a first coaxial RF connector mounted to said switch housing having an inner conductor and an outer conductor;

a second coaxial RF connector mounted to said switch housing having an inner conductor and an outer conductor;

a third coaxial RF connector of a predetermined sex mounted to said switch housing having an inner conductor and an outer conductor;

an actuator movable from a first position to a second position responsive to a mechanical force applied to said third RF coaxial connector, said actuator comprised of a resiliently biased pin biased in a direction away from said RF switch housing and movable in a direction aligned with an insertion axis of said third coaxial RF connector.

16. The RF switch according to claim 15, wherein said resiliently biased pin comprises a bore extending along a portion of a length of said resiliently biased pin from an aperture on a first end portion of said resiliently biased pin, and a tip end defined on a second end portion opposed from said aperture.

17. The RF switch according to claim 16, wherein said tip end engages a switch element when said resiliently biased pin is in said second position.

18. The RF switch according to claim 17, wherein said resiliently biased pin forms an electrical connection with said switch element when said resiliently biased pin is in said second position.

19. An RF switch, comprising:

a switch housing;

a first coaxial RF connector mounted to said switch housing having an inner conductor and an outer conductor;

a second coaxial RF connector mounted to said switch housing having an inner conductor and an outer conductor;

a third coaxial RF connector of a predetermined sex mounted to said switch housing having an inner conductor and an outer conductor;

a ground system forming a ground conductive path connecting said outer conductor of said first, second and third coaxial RF connectors;

an elongated sleeve within said third RF coaxial connector;

an actuator movable within said elongated sleeve from a first position to a second position responsive to a mechanical force applied to said third RF coaxial connector, said actuator comprised of a resiliently biased pin biased in a direction away from said RF switch housing and movable in a direction aligned with an insertion axis of said third coaxial RF connector responsive to a connector insertion force.

20. The RF switch according to claim 19, wherein said tip end engages a switch element when said resiliently biased pin is in said second position.

21. The RF switch according to claim 20, wherein said resiliently biased pin forms an electrical connection with said switch element when said resiliently biased pin is in said second position.

* * * * *